US008528275B2

(12) United States Patent
Paananen

(10) Patent No.: US 8,528,275 B2
(45) Date of Patent: Sep. 10, 2013

(54) GROUND ANCHOR WITH ADJUSTABLE POSITIONING MEMBER

(76) Inventor: Tuomo Paananen, Kumpumäki (FI)

( * ) Notice: Subject to any disclaimer, the term of this patent is extended or adjusted under 35 U.S.C. 154(b) by 0 days.

(21) Appl. No.: 13/359,757

(22) Filed: Jan. 27, 2012

(65) Prior Publication Data

US 2012/0192507 A1 Aug. 2, 2012

(30) Foreign Application Priority Data

Jan. 28, 2011 (FI) ..... 20110029 U

(51) Int. Cl.
*E02D 5/74* (2006.01)

(52) U.S. Cl.
USPC ..... 52/155

(58) Field of Classification Search
USPC ..... 52/155–159, 169.1, 679, 92.2
See application file for complete search history.

(56) References Cited

U.S. PATENT DOCUMENTS

| | | | | |
|---|---|---|---|---|
| 427,815 | A * | 5/1890 | Wolf | 52/165 |
| 891,448 | A * | 6/1908 | Snider | 52/157 |
| 4,863,137 | A * | 9/1989 | Cockman et al. | 248/545 |
| 4,923,165 | A * | 5/1990 | Cockman | 248/545 |
| 5,123,623 | A * | 6/1992 | McNamara | 248/545 |
| 5,695,174 | A * | 12/1997 | Tsai | 256/22 |
| 5,901,526 | A * | 5/1999 | Vidmar et al. | 52/745.09 |
| 6,021,600 | A * | 2/2000 | Everett | 47/33 |
| 6,347,489 | B1 | 2/2002 | Marshall, Jr. et al. | |
| 2004/0206020 | A1 * | 10/2004 | Stuart | 52/169.1 |
| 2005/0188627 | A1 | 9/2005 | Alberts | |
| 2008/0179579 | A1 * | 7/2008 | McGinness et al. | 256/64 |
| 2009/0313916 | A1 * | 12/2009 | Zhu et al. | 52/155 |

FOREIGN PATENT DOCUMENTS

| | | |
|---|---|---|
| WO | WO9833997 | 8/1998 |

* cited by examiner

*Primary Examiner* — Mark Wendell
*Assistant Examiner* — Keith Minter
(74) *Attorney, Agent, or Firm* — Seppo Laine Oy; Joshua P. Wert

(57) ABSTRACT

An adjustable ground anchor comprises an anchoring post for securement in ground, base plate fixed on the top of the anchoring post, and L-shaped brackets on the base plate. Slots in the base plate reside symmetrically in relation to the center of the base plate and extend along a line passing through the center of the base plate. Two L-shaped brackets lay on the base plate, each having a slot in the flange abutting the base plate. A through bolt is mounted through the slot in the base plate and the slot in the flange of the bracket above, wherein the slots allow the bracket to freely move on the base plate prior to tightening the through bolt. The brackets form a retaining portion for a post that is fixed between the upward pointing flanges of the brackets.

7 Claims, 5 Drawing Sheets

GROUND ANCHOR WITH ADJUSTABLE POSITIONING MEMBER

FIELD OF THE INVENTION

This invention relates to a ground anchor for securing elongated members like fence posts and poles. The ground anchor has a lower part constructed as screw anchor or tapering rod and its upper part comprises a fixing for a post or pole.

BACKGROUND ART

Finnish patent No. 115988 describes a ground anchor, which is provided with an elongated tapering part that is driven into the ground and a connecting part. A sleeve for the post is fixed onto the connecting part. The tapering part and the sleeve are attached to each other with a bolt joint. Slots in the connecting part and the sleeve allow adjustment of the relative position of the connecting part and the sleeve before tightening the bolt joint.

When only one bolt joint is used, the attachment will be under severe strain. In this case a massive bolt must be used. In practice the sleeve is also slightly larger than the post so the post can be installed inside the sleeve. Thus the post will be loose from the sleeve at some point, which weakens the joint. In addition, different size posts require their own types of sleeves. This increases manufacturing and transport costs.

An objective of the present invention is to provide a new adjustable ground anchor which is more robust and more versatile than previously known ground anchors.

BRIEF SUMMARY OF THE INVENTION

An adjustable ground anchor comprises an anchoring post for securement in a ground, a base plate fixed on the top of the anchoring post, and L-shaped brackets on the base plate. Two slots in the base plate reside symmetrically in relation to the center of the base plate and extend along a line passing through the center of the base plate. Two L-shaped brackets lay on the base plate. Each bracket has a slot (14) in the flange abutting on the base plate, the slot extending longitudinally between the outer edge and inner edge of the flange but leaving sufficient material between the slot ends and the side edges of the flange to provide structural integrity. A through bolt coupling is mounted through the slot in the base plate and the slot in the flange of the bracket above, wherein the slots allow the bracket to be freely movable on the base plate prior to tightening the through bolt coupling. The brackets form a retaining portion for a post that is fixed between the upward pointing flanges of the brackets.

The retaining portion according to the invention is new and surprising, offering excellent possibilities for adjusting the ground anchor. However, the structure is simple, which decreases manufacturing costs and makes adjustment easier. Adjustment can be made using ordinary tools even in field conditions. In addition to adjusting the relative position of the base plate and retaining portion, the retaining portion itself can now be adjusted, as well. Thus, the same product is suitable for different size posts. The post can also now be attached to the retaining portion more securely than before.

BRIEF DESCRIPTION OF THE DRAWINGS

The invention is described more closely with reference to accompanying drawings, in which.

DETAILED DESCRIPTION

Figure 1A:
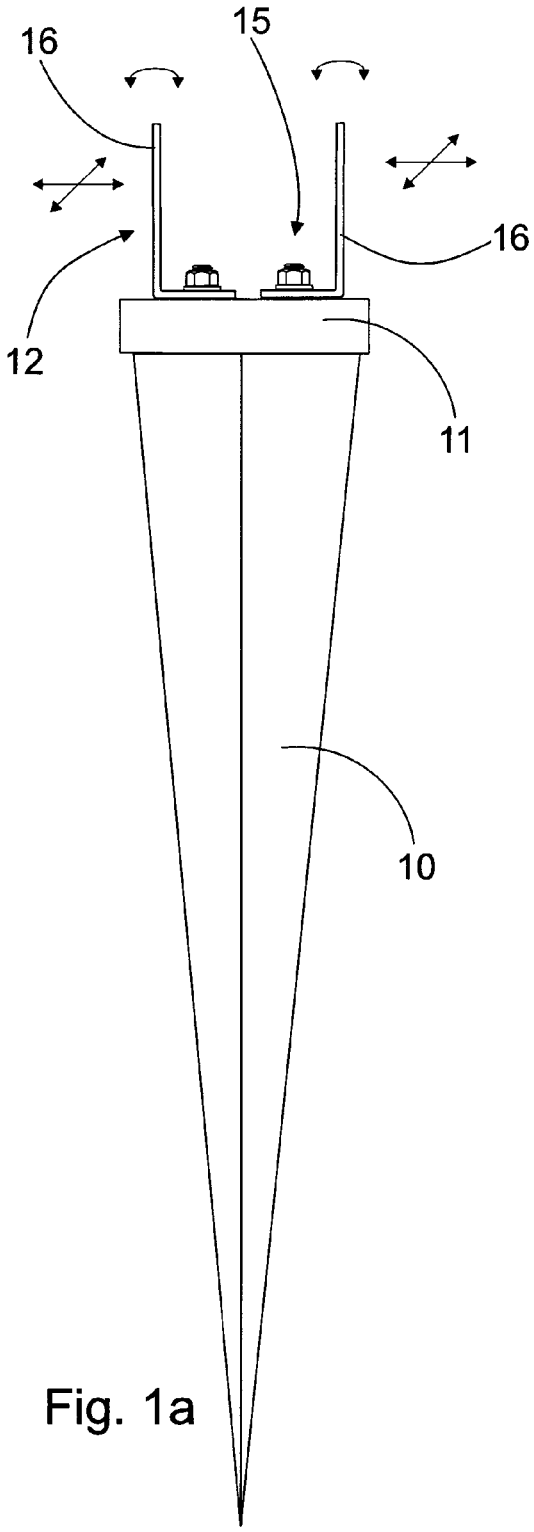
FIG. 1*a* shows a side perspective view of the ground anchor according to the invention.
Figure 2A:
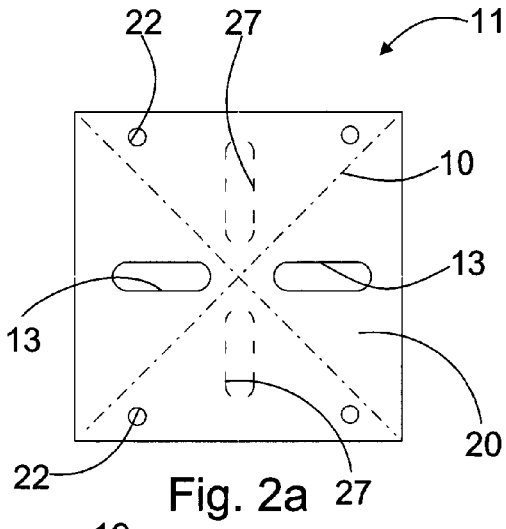
FIG. 2*a* is a top view of the base plate of the ground anchor.
Figure 2B:
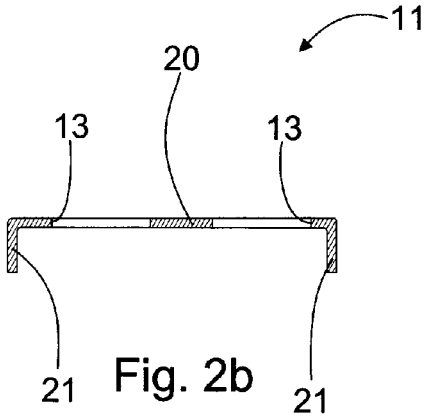
FIG. 2*b* is a cross-sectional view of the base plate according to FIG. 2*a;*
Figure 2C:
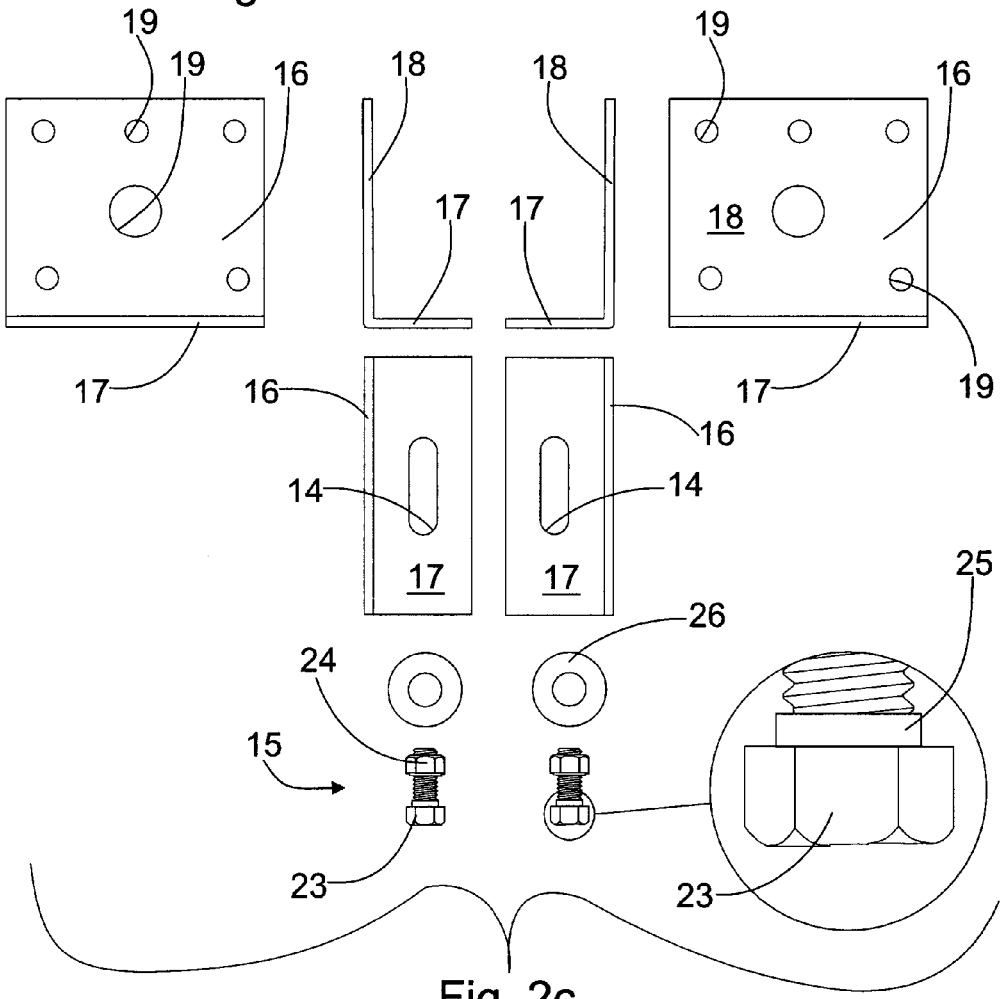
FIG. 2*c* shows the parts of the retaining portion of the ground anchor viewed from different directions according to the invention.

FIG. 1*a* shows the adjustable ground anchor described in these specifications. Here the ground anchor also has anchoring post 10 made from steel plates that have been welded together to form a anchoring post having X-shaped cross section. The anchoring post can also be constructed as screw anchor with a cylindrical shank and a helical ridge formed on the shank. The anchoring post is tapered so as to ease driving it into the ground. The ground anchor also has base plate 11 and retaining portion 12. The retaining portion is intended for the post and is attached to the base plate. Base plate 11 also has first slot 13 and retaining portion 12 has second slot 14 (FIGS. 2*a*-2*c*). A through bolt 15 is fitted through slots 13 and 14 (FIG. 1*a*). The slots and the through bolt are meant both for adjusting the relative position of base plate 11 and retaining portion 12, and for locking base plate 11 and retaining portion 12 together. In other words, the slots enable movement of the retaining portion in relation to the base plate, and vice versa, before the through bolt is tightened. Thus, any deviations in measurements or direction between the ground anchor and a post can be compensated for.

Retaining portion 12 is composed of two separate L-shaped brackets 16 for adjusting the size of retaining portion 12. The base plate also has slots 13 and a through bolt 15 for each L-shaped bracket 16. The optimal grip on the post can be achieved with the two separate L-shaped brackets. The L-shaped brackets can also be set in different positions, meaning that one type of retaining portion is suitable for a number of posts of different sizes and shapes. The support provided by one L-shaped bracket may not be sufficient, but two L-shaped brackets provide support in all directions. The L-shaped brackets presented in these applications are right-angled, but they can be bent during installation. Thus the post can be vertical and straight even if the anchoring memeber was driven in slightly askew.

Figure 1B:
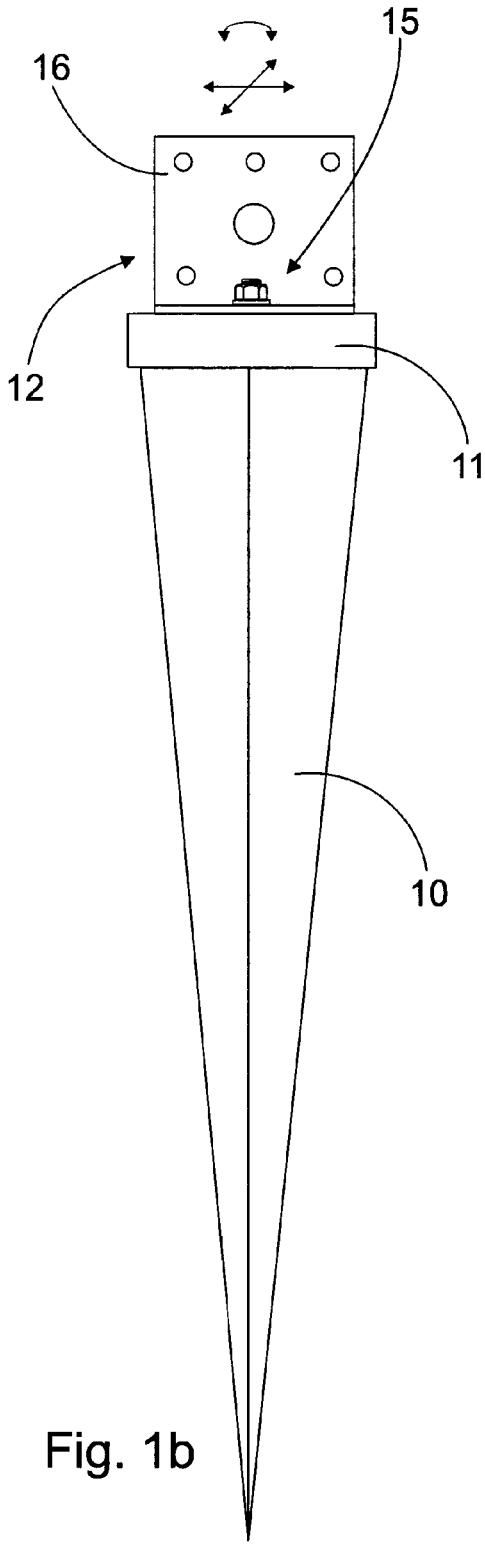
FIG. 1*b* shows the ground anchor of FIG. 1, but rotated 90°.

FIGS. 1*a* and 1*b* show the movement possibilities for the L-shaped bracket. Each L-shaped braket profile can be moved in linear fashion in two different directions, which are at right angles to each other. The through bolt coupling also allows the L-shaped bracket to be rotated at the same time. The slots and the other L-shaped bracket limit movement. If necessary, the through bolt can be opened and the L-shaped bracket turned.

FIG. 2*c* shows two L-shaped brackets 16 viewed from three different directions. Slot 14 is on the shorter flange 17 of L-shaped bracket 16. Longer flange 18 of L-shaped bracket 16 has several holes 19 for fastening the post. Screws can be used for the smaller holes, while the large hole is big enough for a threaded rod. Dimensions of the flanges of the L-shaped brackets are optimised in order to achieve sufficient sturdiness and wide adjustability. A slot, for example, can also be in both flanges. The sharp corners of the flanges can also be rounded off in order to improve the L-shaped bracket's manoeuvrability. At the same time, the risk of accidents can be avoided when installing the ground anchor or moving around close to it.

Optionally, the edges of base plate 11 may be bent to form bent edges 21. This increases the rigidity of the base plate. Dash-dotted diagonals in FIG. 2*a* indicate areas where the uppermost edges of the anchoring post having X-shaped cross section are welded. The uppermost edges of the anchoring post positioned cross-wise in relation to the slots, in order to leave the bolts sufficient room for movement. At the same time, the plates make the base plate even more rigid.

When all edges of the base plate are bent, the load bearing capacity in the areas near each slot is about the same. In addition, the bent edges hide the uppermost portion of the anchoring post when it has been driven into the ground.

FIG. 2*c* shows fastener 15 for attaching the L-shaped bracket to the base plate. The fastener comprise bolt 23 and nut 24. The brackets are set on the base plate so that the slots in the flange at least partially overlaps the slot in the base plate. Therafter the bolt is inserted from underneath through the overlappig slots and the nut is screwed opposite the bolt. Washer 26 is put under the nut. However, the nuts are tightened slack thus allowing adjustment of the brackets along the surface of the base plate. Not until the proper locations of the brackets corresponding the post to be fixed are found, the nuts are tighten firmly.

Preferably bolt 23 has square shoulder 25, which is designed to fit in slot 13 of base plate 11. Thus the bolt can slide in the slot but is prevented from rotating. Thus the bolt joint can be tightened using a single tool. FIG. 2*a* also shows other slots 27 in base plate 11 for both L-profiles 16. Other slots enable even more versatile positioning for the L-profiles. Additional bends can be made to a simple L-shaped bracket, thus improving the ability to affix the post and/or the retaining portion's suitability for different posts.

Figure 3A:
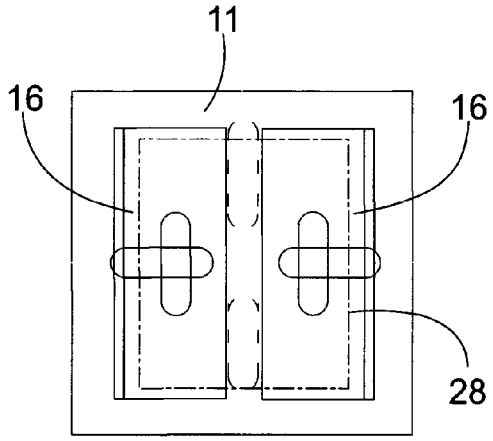
FIG. 3*a*-3*f* shows a side view of the ground anchor according to the invention.

FIG. 3*a* shows the first example of L-shaped bracket positioning. Here L-shaped brackets 16 are parallel and the upward pointing flanges are pointing to opposite directions, so large post 28 can be fastened between the flanges.

Figure 3B:
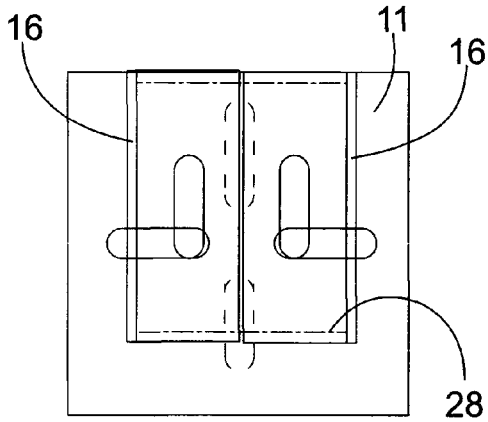

The situation in FIG. 3*b* could occur next. Here both L-shaped brackets 16 have been pressed tightly into post 28 and L-shaped brackets 16 have also been moved towards the edge of the base plate. Thus the post is in the desired position and the nuts can now be tightened. In FIGS. 3*a* and 3*b* the retaining portion has been measured for a post having square cross section.

Figure 3C:
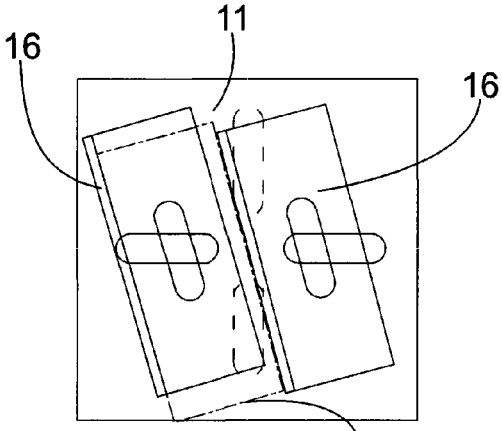

In FIG. 3*c* L-shaped brackets 16 are parallel and the upward pointing flanges are pointing to the same directionso a post having rectangular cross section can be fixed in between the flanges. Here L-shaped brackets 16 have been turned and thus pole 28 can be turned in order to achieve the required position. If necessary, the long flanges of the L-shaped brackets can be set opposite one another, in which case a plank or a board can be attached to the retaining portion (not shown).

Figure 3D:
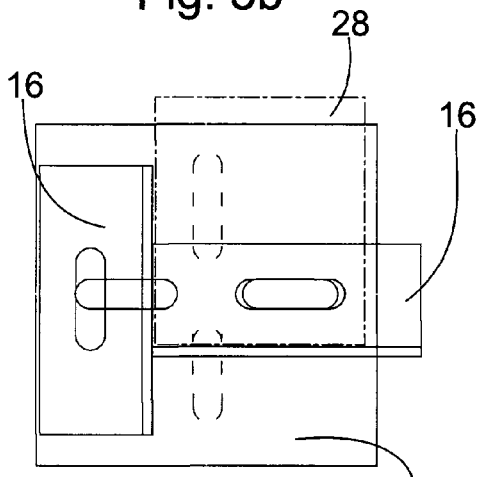
Figure 3E:
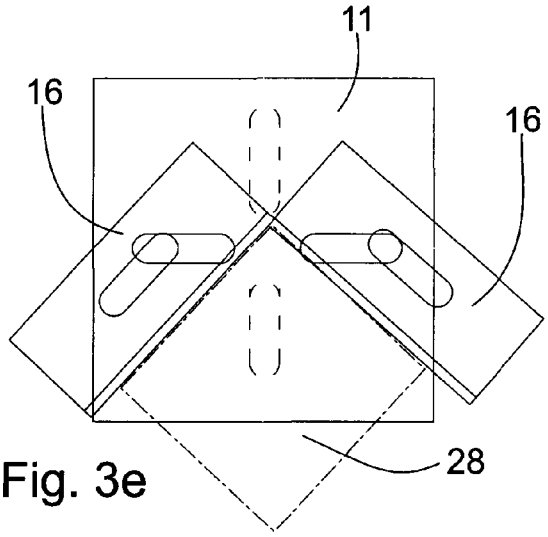

In FIGS. 3*d* and 3*e* L-shaped brackets 16 have been positioned perpendicular to each other, which can be used, for example, in the corners of fence structures or other buildings.

Figure 3F:
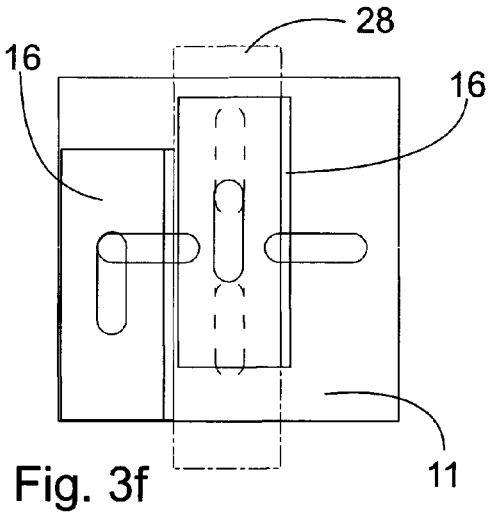

In FIG. 3*f* one of the L-shaped brackets 16 is attached to alternative slot 27. For the sake of clarity, the bolts and nuts are not shown in FIGS. 3*a*-3*f*.

Figure 4:
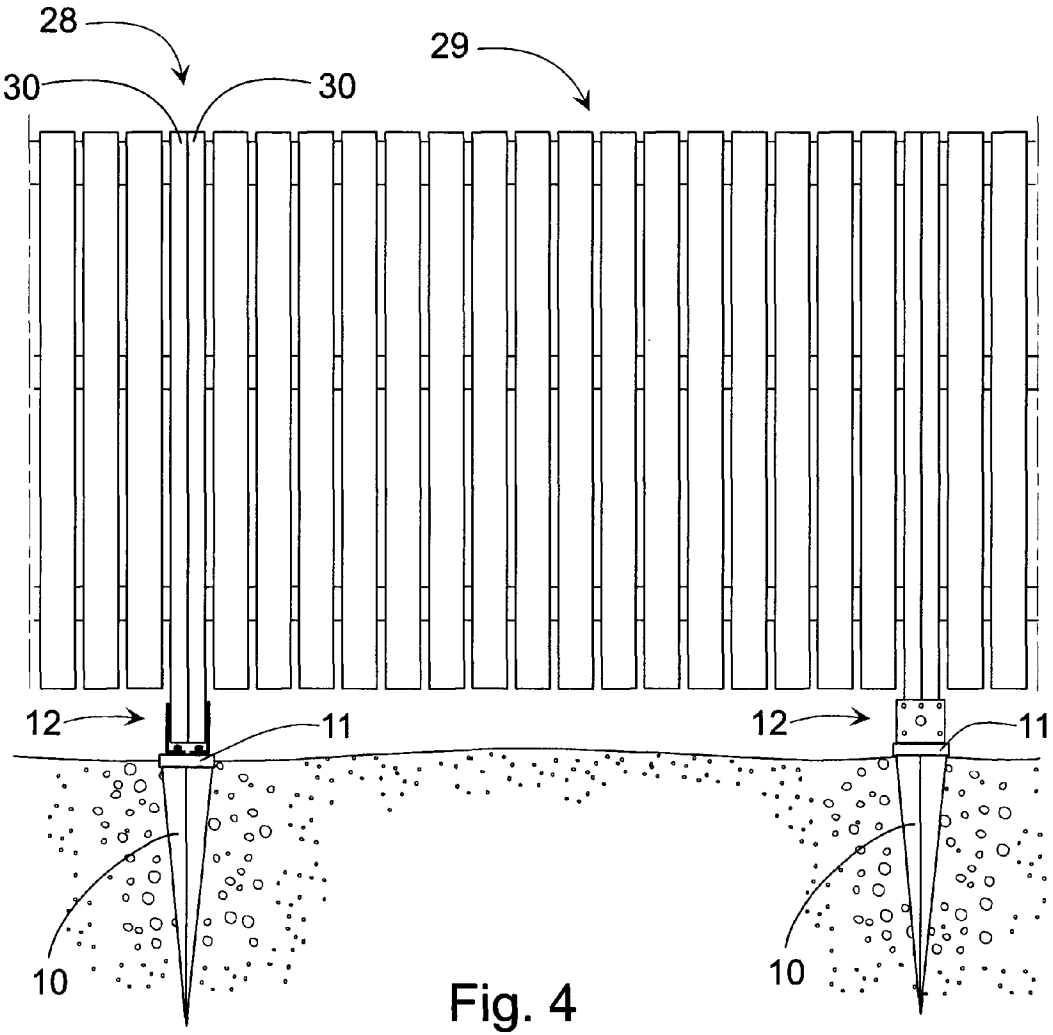
FIG. 4 shows an example of an implementation of the ground anchor according to the invention.

FIG. 4 shows part of fence 29, where posts 28 have been fixed to the ground using the ground anchors described in these specifications. Here, post 28 is formed by two planks 30, each of which is a fixed part of a separate fence element. Thus by attaching two planks to each other, two consecutive fence elements are attached to each other, as well. In this way, separate posts are unnecessary and the fence will look finished and uniform on both sides. Due to the adjustable retaining portion, as described in these specifications, a single vertical plank can also be used as a functional post.

Figure 5A:
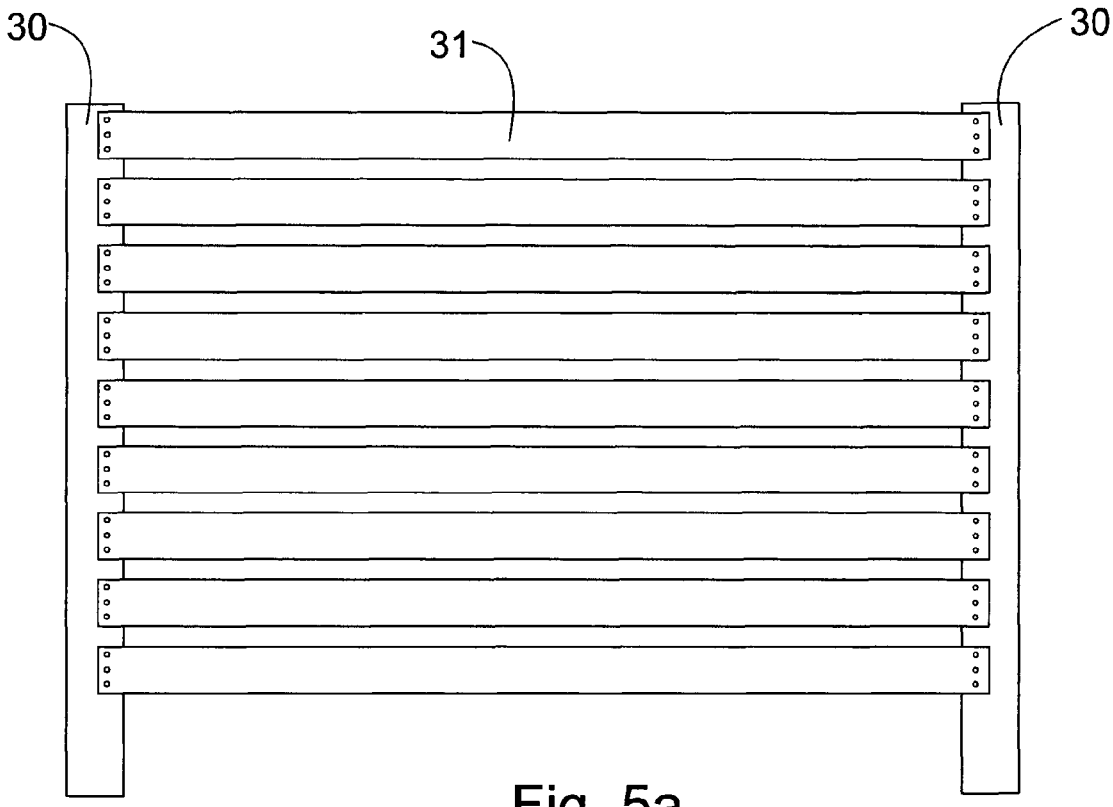
FIG. 5*a* depicts a fence element viewed from the side.
Figure 5B:
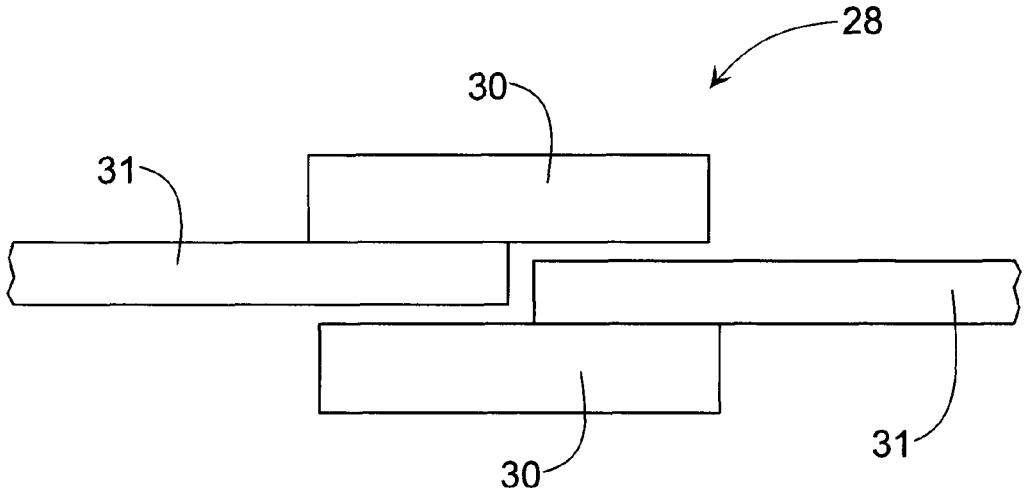
FIG. 5*b* depicts how two fence elements of FIG. 5*a* are fitted together.

FIG. 5*a* shows a fence element where horizontal planks 31 are attached to vertical planks 30. Horizontal planks 31 are attached only on one side of vertical planks 30 about half-way up vertical plank 30. By properly combining these fence elements, fences can be constructed quite quickly without separate posts. Functional post 28 is made when vertical planks 30 are positioned opposite each other as shown in FIG. 5*b* . Horizontal planks 31 of the fence element will remain between the vertical planks.

For the sake of clarity, FIG. 5*b* shows the fence elements slightly apart from each other, but in a completed fence vertical and horizontal planks are tightly attached to each other. The ground anchor described in these specifications is attached to vertical planks. Plywood, for example, can be used instead of horizontal planks. Horizontal planks can be attached to the plywood. If at all possible, the ground anchor is driven deep enough into the ground that the base plate is level with the surface of the ground. The post's upright position is adjusted primarily by selecting a suitable fastening point for the post in the retaining portion. The ground anchors can always be driven into the ground in advance and then adjusted to their exact positions when the fence elements are installed.

A post, in this context, refers to many different types of long, narrow pieces, such as posts, pillars or beams. Adjustability also allows planks and boards to be supported. The necessary strength of material for plate parts depends on the application, but a ground anchor made of 5 mm plate, for example, is sufficiently durable in most common conditions. This thicknes also enables the bending of L-shaped brackets on site. After bending and welding, the various parts are galvanized for a longer life. The structure of the ground anchor described in these specifications is simple but durable, and can be produced using components already on the market. The simple structure is easy and economical to manufacture.

The invention claimed is:

1. An adjustable ground anchor, comprising an anchoring post for securement in a ground, a base plate fixed on the top of the anchoring post, a pair of elongated slots in the base plate, disposed symmetrically in relation to the center of the base plate and extending along a line passing through the center of the base plate, two L-shaped brackets coupled to the base plate, each L-shaped bracket having a long flange portion with at least one hole arranged at an angle to a short flange portion, said short flange portion abutting on the base plate and having an elongated slot, and the short flange portion being shorter than the long flange portion, and a through bolt mounted through the slot in the base plate and the slot in the flange of the L-shaped bracket, wherein the through bolt fastens the base plate and the L-shaped bracket together, but allowing at least one L-shaped bracket to move relative to the base plate prior to tightening the through bolt.

2. The adjustable ground anchor as in claim 1, wherein the base plate is provided with downward-bent edges.

3. The adjustable ground anchor as in claim 1, wherein the through bolt comprises a carriage bolt having a square shoulder, wherein the square shoulder is dimensioned to fit the slot in the base plate.

4. The adjustable ground anchor as in claim 1, wherein the base plate is provided with an additional pair of elongated slots also disposed symmetrically in relation to the center of the base plate and extending along a line passing through the center of the base plate.

5. The adjustable ground anchor as in claim 1, wherein the L-shaped brackets each has an upward pointing flange, provided with at least one hole for screw-fixing the post to the retaining portion.

6. The adjustable ground anchor as in claim 1, wherein the short flange portion and long flange portion are connected along a connection line, wherein the short flange portion extends from said line a distance less than the long flange portion.

7. The adjustable ground anchor as in claim 6, wherein the elongated slot of the short flange portion is parallel to said connection line.

* * * * *